United States Patent [19]

Eyre

[11] Patent Number: 4,867,772

[45] Date of Patent: Sep. 19, 1989

[54] CRYOGENIC GAS PURIFICATION PROCESS AND APPARATUS

[75] Inventor: Douglas V. Eyre, Walnut Creek, Calif.

[73] Assignee: Liquid Air Engineering Corporation, Walnut Creek, Calif.

[21] Appl. No.: 277,550

[22] Filed: Nov. 29, 1988

[51] Int. Cl.[4] ..... F25J 3/02

[52] U.S. Cl. ..... 62/24; 62/42; 62/44

[58] Field of Search ..... 62/11, 23, 24, 32, 36, 62/40, 42, 44

[56] References Cited

U.S. PATENT DOCUMENTS 4,560,397 12/1985 Cheung ..... 62/28

4,711,651 12/1987 Sharma et al. ..... 62/24

*Primary Examiner*—Ronald C. Capossela

*Attorney, Agent, or Firm*—George F. Bethel; Patience K. Bethel

[57] ABSTRACT

A process and apparatus for the ultrapurification of cryogenic low boiling liquified gases such as oxygen and nitrogen which contain trace impurities. The impure gas is introduced into a first distillation column and is substantially at its liquid-gas equilibrium temperature at the pressures within the first distillation column. Here the gas is separated by distillation into a first vapor fraction containing low boiling point impurities and a first liquid fraction containing high boiling point impurities. The first vapor fraction is withdrawn and introduced into a second distillation column. The first vapor fraction is substantially at the liquid-gas equilibrium temperature at the pressures within the second distillation column. Here the vapor fraction is separated by distillation into a second vapor fraction containing high boiling point impurities and a second liquid fraction free of trace impurities which is withdrawn as product. Cooling for the process is provided by indirect heat exchange with a cryogenic low boiling gas such as nitrogen, oxygen, or air. The gas to be purified as well as the heat exchange gas can be obtained from a standard air separation unit or the process can be conducted using gases obtained from storage.

43 Claims, 4 Drawing Sheets

CRYOGENIC GAS PURIFICATION PROCESS AND APPARATUS

BACKGROUND OF THE INVENTION

1. Field of the Invention

This invention relates to the field of purification of low boiling point gases such as nitrogen and oxygen and especially to a process and apparatus for the purification of oxygen in liquid or gas form. The invention is particularly suited to the purification of oxygen produced by standard cyrogenic air separation processes and also to the purification of oxygen obtained from stored cylinders of liquified oxygen.

2. Description of the Prior Art

Standard cryogenic air separation processes involve filtering of feed air to remove particulate matter followed by compression of the air to supply energy for separation. Generally the feed air stream is then cooled and passed through adsorbents to remove contaminants such as carbon dioxide and water vapor. The resulting stream is subjected to cryogenic distillation.

Cryogenic distillation includes feeding the high pressure air into one or more separation columns which are operated at cryogenic temperatures whereby the air components including oxygen, nitrogen, argon, and the rare gases can be separated by distillation. An enriched air product can be obtained through the cryogenic air separation process which ranges from 25% oxygen to about 90% oxygen. It is also possible to produce higher purity oxygen having a purity in the range of 70–99.5% percent oxygen. For example, a stream of oxygen containing 99.5% oxygen contains 0.5% argon and trace amounts of contaminants such as krypton, xenon and various hydrocarbons. In addition, there are trace amounts of nitrogen.

The trace components mentioned above are generally present in parts per million and are not a problem for most applications for the use of oxygen. However, certain industrial processes require extremely high purity levels. For example, the electronics industry presently requires oxygen having a total impurity content of less than 100 ppm. Moreover, the presence of krypton and hydrocarbons are particularly undesirable.

One process which has been suggested for the production of ultra-high purity oxygen is described in U.S. Pat. No. 4,560,397. This process uses a standard double column air separation process and includes a step of withdrawing a vapor stream from the low pressure secondary column at a point above at least one equilibrium stage above the vaporizing oxygen-enriched liquid. This process produces oxygen in gaseous form which for most applications must be subsequently compressed, a process which has the potential to produce undesirable particulates. Also, the process is not suitable for purification of liquified gases stored in cylinders or for oxygen vapor streams withdrawn from standard cryogenic air separation processes which do not fulfill the required high purity standards.

Therefore, it is an object of this invention to provide an improved process for purification of oxygen to produce ultra-high purity oxygen in liquid or gaseous form.

It is a further object of this invention to provide a purification process which is suitable for subsequent purification of both liquid and gaseous oxygen produced by cryogenic air separation processes.

It is a still further object of this invention to provide an improved process for producing ultra-high purity oxygen from oxygen obtained from separate oxygen production processes.

It is a further object of this invention to provide a purification process which is suitable for subsequent purification of both liquid and gaseous nitrogen produced by cryogenic air separation processes.

It is a further object of this invention to provide a purification process which is suitable for purification of nitrogen and other low boiling point gases.

It is a further object of this invention to provide a purification process whereby oxygen obtained from standard storage cylinders can be purified.

It is a further object of this invention to provide a purification process whereby oxygen is purified using nitrogen, oxygen, air or mixtures thereof as the refrigeration medium, which gases may be obtained from air separation or other high purity gas production processes.

SUMMARY OF THE INVENTION

The invention consists of a process for producing ultra-pure low boiling point gases such as nitrogen and preferably oxygen from liquid or gaseous oxygen obtained either from a standard air separation process or other oxygen or nitrogen production process or from liquified oxygen or liquified nitrogen stored in cylinders. Liquified air, oxygen or preferably nitrogen obtained from a standard air separation process or other gas production process or from stored cylinders is used to provide refrigeration for the process.

The process is particularly suitable for the purification of oxygen and the invention will be primarily described with respect to oxygen although the process is suitable for the purification of other low boiling point gases, especially nitrogen.

Nitrogen is the preferred gas for providing refrigeration to the process although other low boiling point gases could be used such as liquified air, liquified oxygen, and mixtures thereof.

The oxygen to be purified, for example in the form of a gas or liquid, is first passed through a main heat exchanger bring the oxygen substantially to its liquid-gas equilibrium temperature at the operating pressures by indirect heat exchange with outgoing waste products and with a nitrogen return stream. From the main exchanger, the oxygen is fed into a stripping column. The stripping column is provided with an upper condenser through which liquid nitrogen is circulated.

Here, rising oxygen vapor comes into indirect heat exchange contact with circulating liquid nitrogen which is substantially at its liquid-gas equilibrium temperature at the existing pressures within the condenser causing the nitrogen to vaporize and the oxygen to condense. This causes any high-boiling point impurities, especially methane to be condensed out of the rising oxygen gas. The oxygen waste stream collected in the bottom of the stripping column is exhausted through the main exchanger where it is warmed by indirect heat exchange contact with incoming nitrogen or feed oxygen prior to venting to the atmosphere.

The rising oxygen vapor, free of methane and other high-boiling point impurities, is fed to a pure column. The pure column is equipped with a reboiler in the bottom providing indirect heat exchange with circulation nitrogen gas, and an upper condenser also providing indirect heat exchange with circulation of nitrogen liquid. In both the condenser and the reboiler, the nitrogen is substantially at its liquid-gas equilibrium temperature at the existing pressures within the respective condenser and reboiler.

In the pure column condenser the incoming oxygen vapor rises to come into indirect heat exchange contact with the liquid nitrogen circulating within the condenser which causes the oxygen vapor to condense within the column and the liquid nitrogen to vaporize within the reboiler.

The falling oxygen liquid is then partially vaporized by indirect heat exchange contact with nitrogen gas circulating through the pure column reboiler. In this manner, there is refluxing of the contents of the pure column. The rising vapor carries argon and small amounts of nitrogen out of the falling condensing oxygen liquid. This causes argon and nitrogen and other trace impurities to be concentrated in the vapor in the upper part of the column. If desired, this vapor can be vented to the atmosphere. Alternately, the vapor withdrawn from the upper portion of the pure column can be fed to an argon separation column for collection of argon.

The condensing liquid oxygen falling to the bottom of the pure column is ultra-pure and can be removed from the bottom of the column as liquid or gaseous oxygen product.

With respect to the nitrogen circulation for refrigeration purposes, gaseous nitrogen from a standard air separation plant or from a high purity nitrogen generation process together with liquid nitrogen makeup or in the alternative from a cylinder of stored liquified nitrogen is fed into the system. In the case of the gaseous nitrogen it is passed through the main exchanger to provide heat to the liquid oxygen waste stream issuing from the stripping column. The nitrogen is then passed according to one embodiment into a nitrogen separator column where the vapor rising to the top of the column is fed to the pure column reboiler and the liquid at the bottom of the column is fed to the stripping column condenser and the pure column condenser.

The liquid nitrogen entering the condensers of the respective stripping column and pure column is vaporized by indirect heat exchange contact with rising oxygen vapor. This causes the oxygen vapor to be condensed.

The nitrogen vapor entering the pure column reboiler is passed into indirect heat exchange contact with falling condensed oxygen liquid causing the nitrogen to become liquified and a portion of the oxygen liquid to be vaporized. This effectively provides boil-up for the column.

The nitrogen liquid issuing from the pure column reboiler is fed to the top pure column condenser where it is added to the nitrogen liquid coming from the nitrogen separator.

According to one embodiment, only the nitrogen liquid exiting from the reboiler is used to circulate through the pure column condenser.

Nitrogen gas exiting from the stripping column condenser and from the pure column condenser are preferably combined and passed through the main heat exchanger. From the main heat exchanger, the nitrogen is compressed in a recirculation blower, and cooled in an after cooler for recirculation throughout the system.

The advantages of this invention are that it can be used as an additional process in conjunction with a standard air separation or other oxygen generation process whereby the oxygen produced can be further processed to provide an ultra-pure grade of oxygen. In this instance, nitrogen can also be provided from the air separation process for use in the oxygen purification process. Alternately, liquified nitrogen stored in cylinders can be used.

Another advantage of this process is that it can be set up on site where a need for high purity oxygen has been established such as in an electronics process requiring high purity oxygen. In this instance, liquid oxygen stored in cylinders and liquid nitrogen stored in cylinders can be used in the invention process.

Separation processes involving vapor and liquid contact depend on the differences in vapor pressure for the respective components. The components having the higher vapor pressure meaning that it is more volatile or lower boiling has a tendency to concentrate in the vapor phase. The component having the lower vapor pressure meaning that it is less volatile or higher boiling tends to concentrate in the liquid phase.

The separation process in which there is heating of a liquid mixture to concentrate the volatile components in the vapor phase and the less volatile components in the liquid phase defines distillation. Partial condensation is a separation process in which a vapor mixture is cooled to concentrate the volatile component or components in the vapor phase and at the same time concentrate the less volatile component or components in the liquid phase.

A process which combines successive partial vaporizations and condensations involving countercurrent treatment of the vapor in liquid phases is called rectification or sometimes called continuous distillation. The countercurrent contacting of the vapor and liquid phases is adiabatic and can include integral or differential contact between the phases.

Apparatus used to achieve separation processes utilizing the principles of rectification to separate mixtures rae often called rectification columns, distillation columns, or fractionation columns.

When used herein and in the claims, the term "column" designates a distillation or fractionation column or zone. It can also be described as a contacting column or zone wherein liquid or vapor phases are countercurrently contacted for purposes of separating a fluid mixture. By way of example this would include contacting of the vapor and liquid phases on a series of vertically spaced trays or plates mounted within the column. In place of the trays or plates there can be used packing elements to fill the column.

"Double column" as used herein refers to a higher pressure column having its upper end in heat exchange relation with the lower end of a lower pressure column.

The term "a standard air separation process or apparatus" as used herein is meant to describe that process and apparatus as above described as well as other air separation processes well known to those skilled in the art.

As used herein and in the appended claims, the term "indirect heat exchange" means the bringing of two fluid streams into heat exchange relation without any physical contact or intermixing of the fluids with each other.

As used herein and in the appended claims, the term "liquid-gas equilibrium temperature at the operating pressures" is meant to designate that temperature at a specific operating pressure where the gas or gas mixture, has a vapor pressure substantially equal to the operating pressure. For example, at 54.35 K the vapor pressure of oxygen is 0.001 atm; at 84 K the vapor pressure of oxygen is 0.497 atm; at 90.180 K the vapor pressure of oxygen is 1 atm; at 100 K the vapor pressure is 2.509 atm. Similar vapor pressure values as a function of temperature for helium-4, hydrogen, neon, and nitrogen can be found in standard reference books such as The Handbook of Chemistry and Physics published by CRC Press of Cleveland, Ohio 44128 on pages D-212–D214. It should be kept in mind that the values given in such references deal with a single gas. When dealing with gas mixtures as is the case when gases are impure, the liquid-gas equilibrium temperature at a given pressure will depend upon the percentage of each gas within a given mixture.

In any event, the liquid-gas equilibrium temperature for a specific gas or gas mixture is below the critical temperature for that gas. The term "dewpoint" refers to the temperature at which the first drop of liquid appears. Dewpoint is used interchangeably with the "liquid-gas equilibrium temperature".

The term "impurities" is meant to include all components other than the oxygen being purified. Examples of such impurities to be found in oxygen include but are not limited to argon, krypton, xenon, and hydrocarbons such as propane, butane, and methane.

These impurities are present in the initial air used to produce the oxygen. Since cryogenic separation of feed air involves the separation by distillation, the separate components remain in the product streams depending on their vapor pressure relative to one another. Of the primary components in the feed air, nitrogen is the most volatile, argon has intermediate volatility, and oxygen is the least volatile component.

Additional trace components such as helium and hydrogen are more volatile than nitrogen and normally exit the air separation plant with nitrogen-rich streams. However, other trace components such as krypton and xenon are less volatile than oxygen and thereby will concentrate with the oxygen product. Similarly, other heavy components such as propane, butane, and methane, are also less volatile than oxygen and will concentrate with the product oxygen. The trace impurities involved are generally in the parts per million purity range and are not normally an impurity for conventional oxygen uses.

The electronics industry requires oxygen products having a total impurity content of less than 100 ppm or even less than 10 ppm. In addition, the presence of krypton and hydrocarbons are especially detrimental to the quality of products associated with the electronics industry.

The term "ultrapure" as used herein refers to gases containing less than 100 ppm of trace impurities. The process of the invention can produce ultrapure oxygen product containing less than 0.1 ppm trace hydrocarbons and less than 10 ppm argon.

The term "stored nitrogen" or "stored oxygen" as used herein and in the claims refers to nitrogen or oxygen stored in pressurized cylinders or tanks as opposed to newly generated oxygen or nitrogen.

The term "cryogenic low boiling liquified gases" is meant to include gases liquifiable at cryogenic temperatures including among others nitrogen, oxygen, argon, hydrogen, and mixtures including air.

The invention will be more readily understood by reference to the description which follows taken in conjunction with the attached drawings.

DETAILED DESCRIPTION

Figure 1:
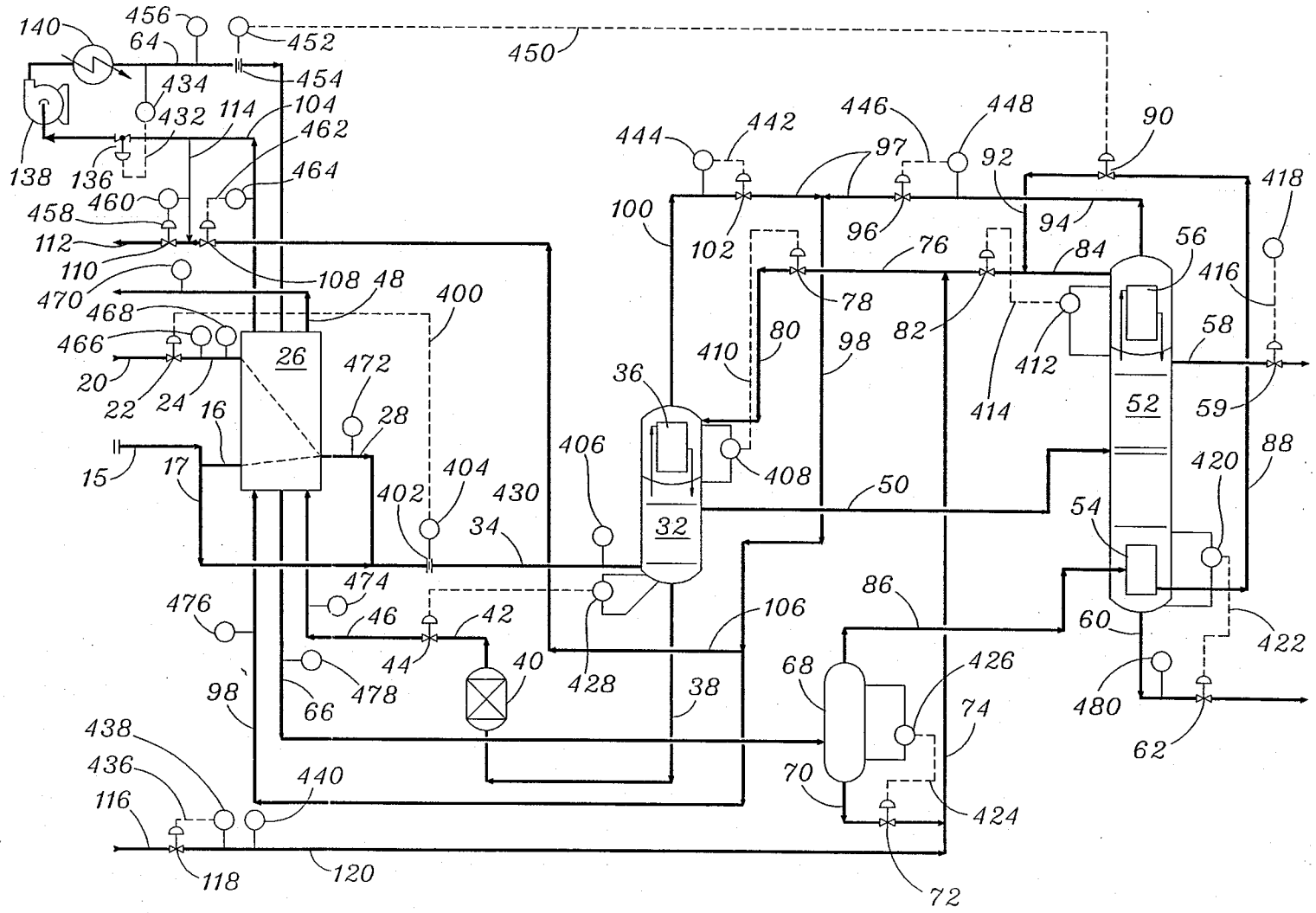
FIG. 1 is a flow sheet of a preferred embodiment showing the process steps and apparatus utilizing either gaseous oxygen feed or liquid oxygen feed.

Referring now to FIG. 1, it can be seen that gaseous oxygen feed enters line 20 and passes through valve 22 and line 24 prior to passage through main exchanger 26. In main exchanger 26, the gaseous oxygen feed is cooled by indirect heat exchange with waste product and with exiting nitrogen recirculation streams which streams are thereby warmed prior to passing out of the system.

Alternately, liquid oxygen, for example from liquid storage or from an air separation process can be introduced through line 15. Or as a further alternative both liquid and gaseous feed may be used which can provide a means for balancing the heat within the main exchanger 26 and the temperature of the oxygen flowing within line 34. The liquid oxygen flow can be split, one portion entering the heat exchanger via line 16 and the remaining portion flowing through line 17 and line 34 to stripping column 32.

The oxygen which is near its dewpoint temperature exits the exchanger 26 through line 28 and is introduced into stripping column 32 via line 34.

The oxygen within the stripping column 32 is separated by fractionation into a vapor fraction which rises into contact with the stripping column condenser 36 and an impurity-enriched liquid fraction which falls to the bottom of column 32. The liquid produced in the bottom of stripping column 32 is removed via line 38 and contains methane and other hydrocarbon impurities. It is passed through liquid oxygen filter 40 containing a silica gel adsorbent to remove hydrocarbon impurities. This is done to avoid deposit of solid hydrocarbons on the walls of the heat exchanger which could produce a danger of explosion in the presence of oxygen.

From the filter 40, the waste oxygen is passed through line 42, valve 44 and line 46 prior to passage through main exchanger 26. Here the liquid is warmed by contact with incoming gaseous oxygen feed before being discharged through line 48.

If desired the waste oxygen produced thereby can be used for purposes which do not require high purity or can be returned to an air separation process for further purification according to standard air separation methods.

The oxygen vapor rising within stripping column 32 comes into indirect heat exchange contact with condenser 36 which has a liquid gas such as nitrogen circulating therethrough. When the rising oxygen vapor comes in contact with the condenser 36 it is condensed and falls to the bottom of the column providing reflux for column 32.

In this manner, the higher boiling impurities are concentrated in the bottom liquid and the purer oxygen vapor is concentrated near the top of the column 32.

The oxygen vapor stripped of methane and other impurities can be withdrawn through line 50 near the top of the stripping column 32. The oxygen vapor is then introduced into the purer column 52 for further separation Pure column 52 is provided with a reboiler 54 having nitrogen vapor or other gas circulating therethrough and a condenser 56 having a liquid gas such as nitrogen circulating therethrough.

Within the column 52, the entering oxygen vapor rises to the top of the column where it is brought into indirect heat exchange contact with condenser 56 causing the oxygen vapor to condense and fall down toward the bottom of the column. Here the condensed oxygen vapor comes into indirect heat exchange contact with the reboiler 54 having relatively warm nitrogen vapor circulating therethrough. This causes the condensed oxygen liquid to vaporize producing a countercurrent flow of rising oxygen vapor and fallig liquid oxygen vapor.

The rising oxygen vapor effectively removes the lower boiling components such as argon, krypton, and nitrogen. The oxygen vapor found near the top of the pure column 52 contains the concentrated impurities and can be withdrawn from line 58 through valve 59.

If desired, this oxygen vapor removed from line 58 can be sent to a crude argon column known to those skilled in the art for purposes of separating argon from the gas mixture. Alternately the oxygen vapor from line 58 can be used as a source of oxygen where high purity is not required, or the oxygen vapor can be returned to an air separation process.

The condensed liquid oxygen falling to the bottom of column 52 is ultra-pure having the impurities removed from it. The ultra-pure oxygen liquid can be removed as product through line 60 and expanded if desired through valve 62 and sent directly to the point of use or if desired stored in cylinders for future use.

The cooling for the plant is provided with nitrogen. The nitrogen can be obtained from a standard air separation process or if desired the nitrogen can be obtained from storage tanks or cylinders of liquified nitrogen. The preferred system circulates and recycles nitrogen from whatever source through a blower to increase the pressure thereof.

As shown in FIG. 1, liquid nitrogen from storage tanks or cylinders or from an air separation or other nitrogen generation process is introduced into the system via line 116. It passes through valve 118 and line 120 where it enters line 74.

Line 74 enters line 76 where the liquid nitrogen is split into two parts. One portion passes through valve 78 and line 80 prior to its introduction into stripping column condenser 36. The remaining portion of nitrogen liquid in line 76 is passed through valve 82 and line 84 where it is introduced into pure column condenser 56.

The liquid nitrogen entering pure column condenser 56 from line 84 is brought into indirect heat exchange relation with the oxygen vapor rising within pure column 52. Contact of the oxygen vapor with the pure column condenser 56 causes the oxygen vapor to condense and fall down to the bottom of pure column 52. At the same time the indirect heat exchange contact of the oxygen liquid with the gaseous nitrogen in pure column reboiler 54 causes the nitrogen to condense and this liquid passing through line 88 and control valve 90 forms part of the liquid feed to condenser 56. The vaporized nitrogen is withdrawn from the pure column condenser 56 via line 94. From line 94, the nitrogen vapor is passed through valve 96 and line 97 to line 98.

At the same time, liquid nitrogen entering the stripping column condenser 36 via line 80 is brought into indirect heat exchange contact with rising oxygen vapor within stripping column 32. This causes the oxygen vapor to condense and fall down to the bottom of the stripping column 32. At the same time the liquid nitrogen is thereby warmed to produce a vapor which is withdrawn from the stripping column condenser 36 via line 100. From line 100 the nitrogen vapor passes through valve 102 to line 97 where it flows into line 98 to join the vapor coming from the pure column condenser 56.

Most of the nitrogen gas flowing through line 98 is passed through the main exchanger where it is warmed by indirect heat exchange with incoming oxygen gas and nitrogen gas.

Upon exiting the main exchanger 26, the gaseous nitrogen is passed through line 104 and valve 136 to a nitrogen blower 138 where it is repressurized. This causes an increase in temperature of the nitrogen gas. The temperature is reduced by passage through an aftercooler 140 having water or other cooling medium including ambient air circulating therethrough. From aftercooler 140, the nitrogen which has been cooled substantially to ambient temperature is passed through line 64 into main heat exchanger 26.

If desired, a portion of the nitrogen exiting the main exchanger to the blower 138 via line 104 can be diverted and vented by means of line 114 where it can be passed through valve 110 and line 112 if desired. Additional nitrogen can be added as needed through line 116 to balance any nitrogen which is removed from the system via line 112.

A portion of the nitrogen flowing through line 98 can be passed through line 106 which bypasses the main exchanger 26 and flows through valve 108 and 110 to line 112 where it can be vented to the atmosphere or if desired it can be returned to a standard air separation process column.

Nitrogen gas entering the main heat exchanger 26 via line 64 is cooled to its dewpoint temperature by indirect heat exchange with the outgoing impurity rich bottoms product withdrawin from the stripping column 32 via line 38.

The cooled nitrogen exiting the main exchanger 26 via line 66 is introduced into nitrogen separator 68. Within nitrogen separator 68 the incoming nitrogen is separated into a vapor portion and a liquid portion. The liquid portion falls to the bottom of the nitrogen separator 68 and is withdrawn via line 70 and passed through valve 72 to line 74 where it is combined with liquid nitrogen coming from line 120.

At the same time the nitrogen vapor from nitrogen separator 68 is withdrawn from the top of the nitrogen separator 68 via line 86 and is introduced into the pure column reboiler 54. In the pure column reboiler 54 the nitrogen vapor is brought into indirect heat exchange contact with condensing liquid oxygen falling to the bottom of the pure column reboiler 54. This causes a warming of the oxygen liquid to form vapor and at the same time causes a liquification of the nitrogen which is withdrawn from the pure column reboiler 54 via line 88.

The liquid nitrogen passing through line 88 flows through valve 90 and line 92 where it enters line 84. Here it combines with the liquid nitrogen flowing through valve 82 from line 76 to enter the pure column condenser 56.

The oxygen purification system is typically provided with various temperature, pressure and flow controls and sensors which are connected to various valves within the system. These controls and other indicators permit precise monitoring and control of temperature, pressure, and flow rates within the system.

Valve 22 within line 20 has a control loop 400 responsive to an orifice plate 402, and a flow control 404 within line 34. Line 34 is also provided with a pressure control 406 to monitor pressure within line 34.

A level control 408 has a control loop 410 connected to valve 78. A similar level control 412 has a control loop 414 connected to valve 82.

Similarly, level control 420 has a control loop 422 connected to valve 62. Level control 426 has a control loop 424 connected to valve 72. Level control 428 has a loop 430 connected to valve 44. Valve 102 has a loop 442 connected to pressure control 444. Valve 96 has a loop 446 connected to pressure control 448. Valve 90 in line 88 has a loop 450 connected to a control 452 responsive to an orifice plate 454 in line 64. Line 64 also includes a temperature control 456.

Valve 110 in line 112 has a loop 458 connected to a pressure control 460 in line 114. Valve 108 has a control loop 462 connected to a temperature control 464 in line 104.

Valve 136 in line 104 has a control loop 432 connected to a pressure control 434. Valve 118 in line 116 has a control loop 436 connected to a pressure control 438 in line 120.

Other sensors which are typically provided for operating the plant include the following sensors. There is a pressure control 480 in line 60. There is also a temperature control 440 within line 120. There is a temperature control 466 and a pressure control 468 in line 24, and a temperature control 470 in line 48. Line 28 has a temperature control 472 and line 46 has a temperature control 474. Line 98 has a temperature control 476 and line 66 has a temperature control 478.

Valve 59 has a suitable control loop 416 connected to a manual control 418, but which could also be responsive to a temperature or analyzer control on line 58. This valve assures proper venting of the argon-rich gas.

Figure 2:
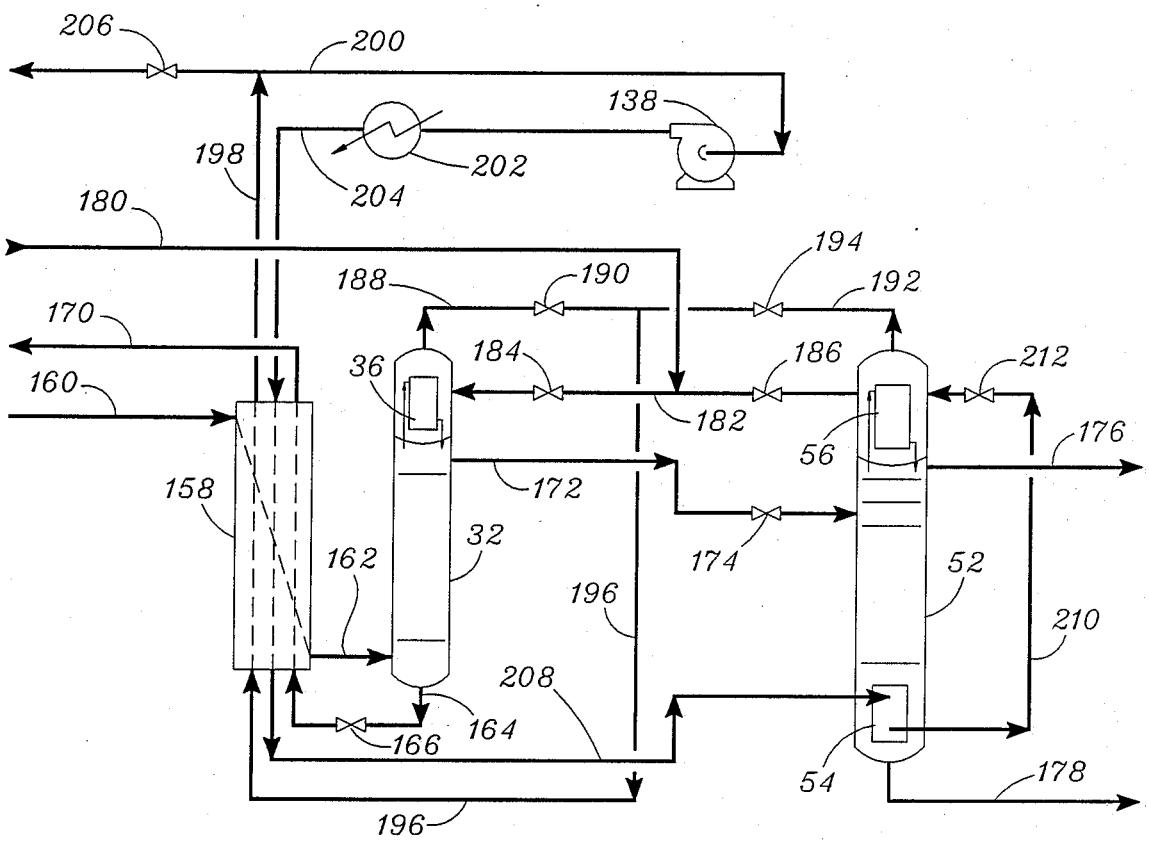
FIG. 2 shows a schematic representation of a preferred embodiment of the invention wherein the oxygen to be purified is supplied from standard storage cylinders and the nitrogen gas providing refrigeration is also supplied from standard nitrogen storage cylinders.

Referring now to FIG. 2 there is shown an embodiment shown in schematic form whereby the nitrogen gas used for the cooling in the process as well as the oxygen to be subjected to the ultra-purification process are supplied from existing storage cylinders.

In a manner similar to that shown in FIG. 1, oxygen to be purified from liquid oxygen storage enters heat exchanger 158 by means of line 160. In main heat exchanger 158 the oxygen is brought into indirect heat exchange contact with outgoing waste products.

The oxygen exits the main exchanger 158 and enters the stripping column 32 through line 162. Within stripping column 32 the oxygen is separated into a vapor fraction which rises into indirect heat exchange contact with condenser 36 causing condensation of the oxygen vapor providing reflux for the column 32.

Liquid collecting in the bottom of stripping column 32 contains the methane-enriched waste product. This waste product is withdrawn from the bottom of column 32 through line 164 and valve 166 to enter main exchanger 158 prior to exiting the system through line 170.

At the same time the rising oxygen vapor cleansed of methane and other impurities is withdrawn from column 32 via line 172 where it is introduced to pure column 52 after passing through valve 174.

The oxygen vapor entering pure column 52 is condensed by indirect heat exchange contact with condenser 56 at the top of column 52 and reboiled by contact with reboiler 54 in the bottom of column 52. This causes separation of low boiling impurities in the oxygen vapor to rise with the vapor and are withdrawn along with the oxygen vapor at line 176.

If desired the oxygen gas exiting at 176 can be passed into a crude argon column for removal of argon. Alternately, the oxygen gas can be used in processes which can tolerate the presence of argon.

The liquid oxygen falling to the bottom of the column 52 is ultra-pure and can be removed via line 178 for immediate use or for liquid oxygen storage.

The nitrogen used for indirect heat exchange in the condensers 36 and 56 and in the reboiler 54 enters the system from existing liquid nitrogen storage through line 180. From line 180 the liquid nitrogen enters line 182 where part of the liquid nitrogen passes through valve 184 prior to entering condenser 36 of column 32. The remaining portion enters condenser 56 after passing through valve 186. In both instances the liquid nitrogen is brought into indirect heat exchange contact with oxygen vapor contained within columns 32 and 52.

In the course of this process of indirect heat exchange the liquid nitrogen is vaporized by being warmed by the oxygen vapor. The thus vaporized nitrogen is withdrawn from condenser 36 via line 188 after which it passes through valve 190. In a similar fashion the nitrogen liquid which has been vaporized in condenser 56 exits in the form of a vapor through line 192 and valve 194. The nitrogen gas passing through valves 190 and 194 are combined in line 196. From line 196 the nitrogen vapor is then introduced into main exchanger 158 where it is brought into heat exchange contact with outgoing waste from column 32 which exits via line 164.

The nitrogen vapor exits the main exchanger 158 through line 198. Here it enters line 200 where a major portion is circulated through blower 138 for repressurizing and aftercooler 202. After passing through aftercooler 202 the repressurized nitrogen vapor reenters heat exchanger 158 through line 204.

If desired a portion of the nitrogen vapor entering line 200 can be vented by passage through valve 206.

The nitrogen exiting the heat exchanger 158 by means of line 208 is introduced into reboiler 54. Here the nitrogen vapor is brought into indirect heat exchange contact with liquid oxygen which is thereby warmed and the nitrogen vapor is condensed so that liquid nitrogen exits reboiler 54 through line 210. The liquid nitrogen from line 210 is passed through valve 212 where it is added to the liquid nitrogen entering condenser 56 from line 182.

Figure 3:
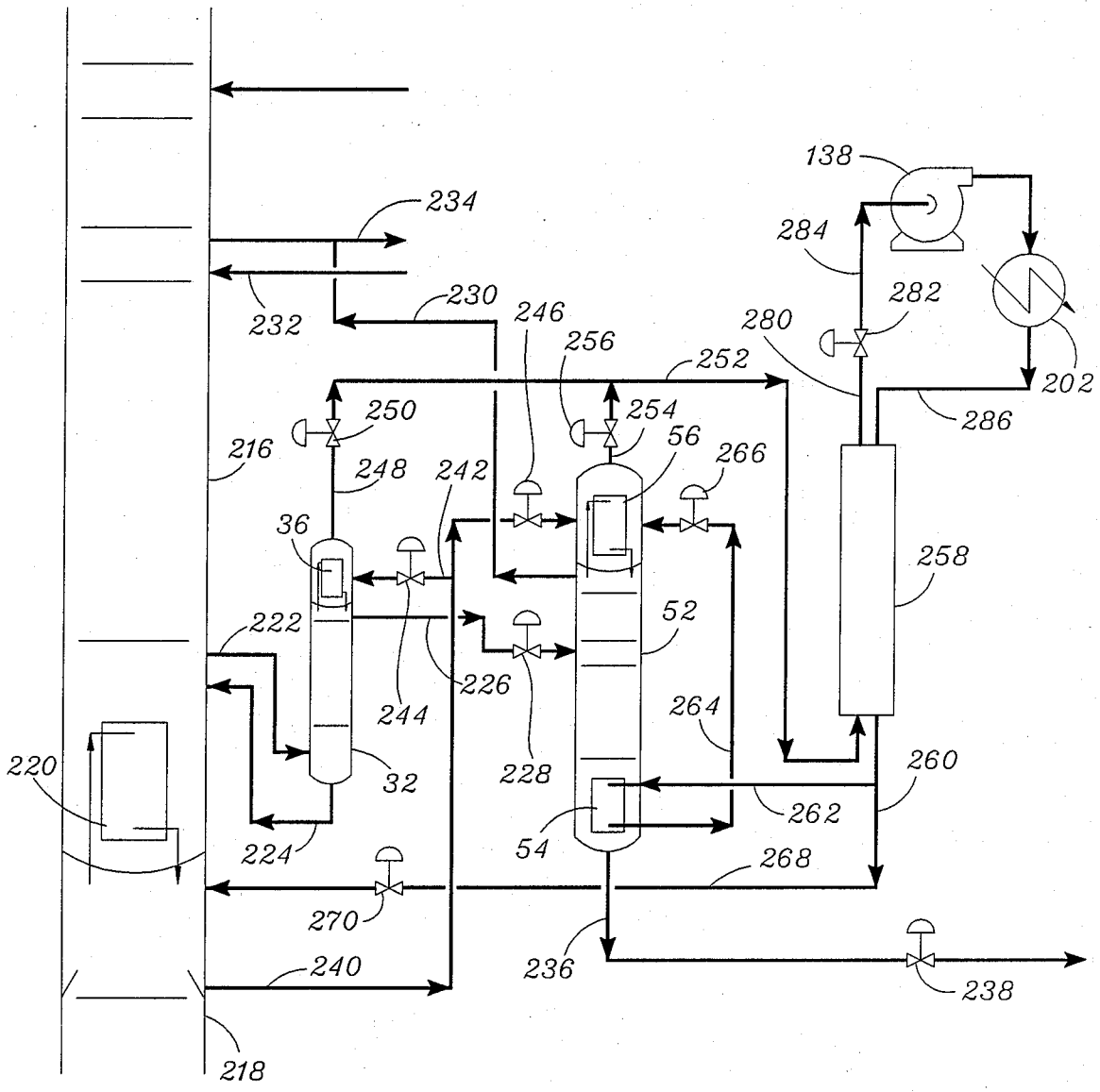
FIG. 3 shows a preferred embodiment of the invention wherein the oxygen to be purified is obtained from a standard air separation process as is the nitrogen required for refrigeration of the plant.

FIG. 3 shows an embodiment of the invention whereby the oxygen to be subjected to the subsequent purification process as well as the source for the nitrogen used for refrigeration are obtained from a standard air separation process.

FIG. 3 shows a partially broken away portion of a double column air separator which includes a portion of the high pressure column 218 and a portion of the low pressure column 216.

It can be seen that the low pressure column 216 contains a condenser 220 which is in indirect heat exchange relationship with the top of the high pressure column 218.

Oxygen can be withdrawn from low pressure column 216 through line 222 from which it is introduced into stripping column 32. Withdrawal can be either in liquid or gaseous form depending upon the location of withdrawal from the column.

In the stripping column, rising oxygen vapor is brought into indirect heat exchange contact with condenser 36 causing the vapor to condense and fall back to the bottom providing reflux for this column. At the same time, the trace hydrocarbon impurities such as methane become concentrated in the liquid falling to the bottom of column 32. This can be withdrawn through line 224 and reintroduced into low pressure column 216 for further air separation processing.

The purified oxygen vapor stripped of its trace hydrocarbon impurities by the countercurrent reflux action within column 32 is withdrawn near the top of column 32 though line 226. It is passed through valve 228 prior to its introduction into pure column 52.

Within pure column 52 rising oxygen vapor is brought into indirect heat exchange contact with condenser 56 causing it to fall down to the bottom of the column. The falling condensed oxygen collects in the bottom of column 52 where it is brought into indirect heat exchange contact with reboiler 54. Here, the oxygen liquid is warmed causing vaporization of the oxygen liquid to cause the cycle to repeat itself producing countercurrent reflux flow. In the time condensing oxygen liquid becomes increasingly more pure with the argon and other trace impurities including nitrogen being carried upwardly by the rising oxygen vapor to be withdrawn from column 52 through line 230.

From line 230 the oxygen vapor can be returned to the low pressure column 220 through line 232 or it can be sent to a crude argon column through line 234.

This permits removal of the argon from the oxygen which can then be collected and used as desired. The waste from this process can be returned to the low pressure column 216 or used as a lower purity source of oxygen.

The condensed oxygen liquid collecting in the bottom of column 52 is rendered ultrapure by the reflux action within the column. The ultrapure oxygen can be collected and withdrawn from column 52 via line 236 and valve 238. The purity of the oxygen is very high containing less than 0.1 ppm trace hydrocarbons and less than 10 ppm of argon and other trace impurities.

The nitrogen which is used for indirect heat exchange within condensers 36 and 56 and reboiler 54 is obtained from high pressure column 218. The nitrogen within column 218 which is condensed by indirect heat exchange contact with condenser 220 in the bottom of low pressure column 216 is collected and withdrawn through line 240. Nitrogen gas can also be used if desired. This would require withdrawal from a different location in the high pressure column.

A portion of the withdrawn liquid nitrogen is introduced into condenser 36 through line 242 and valve 244. The remaining portion of nitrogen is introduced into condenser 56 after passage through valve 246.

In the process of circulation through condensers 36 and 56 respectively, the liquid nitrogen is vaporized by indirect heat exchange contact with rising oxygen vapor. In condenser 36 the nitrogen vapor is withdrawn from condenser 36 through line 248 and passes through valve 250 and line 252.

In a similar manner, nitrogen vaporized by passage through condenser 56 is withdrawn through line 254 and valve 256 before entering line 252 to combine with the nitrogen coming from condenser 36.

The combined flow of nitrogen vapor from condenser 36 and condenser 56 passes through heat exchanger 258. The combined flow exits via line 280 through valve 282 and line 284 to enter blower 138 where it is repressurized. Upon exiting blower 138 the nitrogen passes through aftercooler 202 and line 286 prior to entering heat exchanger 258.

From heat exchanger 258 the nitrogen gas exits via line 260, a portion of which is introduced via line 262 into reboiler 54 at the bottom of pure column 52. Within reboiler 54 the nitrogen vapor is brought into indirect heat exchange contact with condensed oxygen liquid causing the oxygen liquid to be vaporized and the nitrogen vapor to be condensed.

The condensing nitrogen liquid is withdrawn from reboiler 54 via line 264 and passed through valve 266 where it is introduced into condenser 54 where it is combined with nitrogen liquid entering condenser 54 through valve 246.

The remaining portion of nitrogen gas which is not sent to reboiler 54 is passed via line 268 through valve 270 into the upper portion of high pressure column 218 for further reaction within that column.

Figure 4:
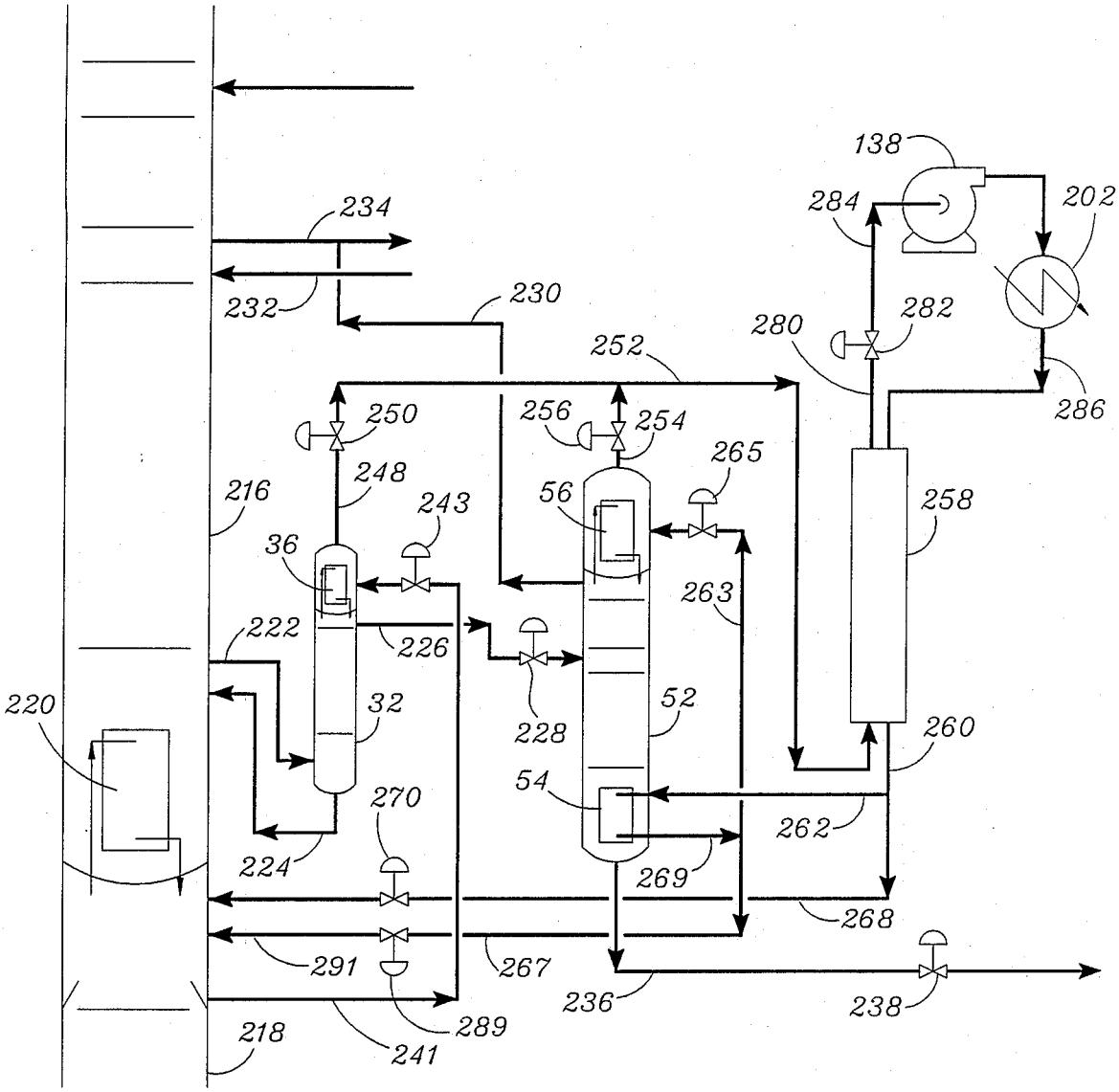
FIG. 4 is a schematic representation showing a preferred embodiment similar to FIG. 4 but with a slightly different arrangement of nitrogen recirculation.

FIG. 4 is an embodiment of the invention which is similar to FIG. 3 but which has a different arrangement of nitrogen circulation. In FIG. 4 the elements which remain the same have the same number designations and those elements which are different have different number designations.

Liquid nitrogen from high pressure column 218 is withdrawn from line 241 and introduced into condenser 36 of stripping column 32 after passage through valve 243. The withdrawal of vaporized nitrogen exiting condenser 36 and condenser 56 to blower 138 is the same as described in the embodiment of FIG. 3.

In FIG. 4 the nitrogen exiting from heat exchanger 258 passes through line 260 and line 262 into reboiler 54 of pure column 52 in the same manner as in FIG. 3.

The nitrogen gas within the reboiler 54 is in indirect heat exchange relation with liquid oxygen condensing and falling through column 52. The liquid oxygen is warmed by the nitrogen gas which is in turn thereby liquified. The nitrogen liquid is then withdrawn from reboiler 54 through line 269. Here the nitrogen liquid is split when it enters line 263. A portion of the nitrogen liquid is passed upwardly through valve 265 to provide indirect heat exchange cooling for condenser 56. The remaining portion passes through line 267, valve 289 and line 291 where it is reintroduced into high pressure column 218.

Thus, the main difference between the embodiment of Figure 4 and that of FIG. 3 is that the nitrogen liquid withdrawn initially from high pressure column 218 through line 240 is split to provide liquid nitrogen to both condensers 36 and 56 in the embodiment of Figure 3. In the embodiment of FIG. 4 the liquid nitrogen from high pressure column 218 is only introduced into condenser 36. The source of liquid nitrogen for condenser 56 comes entirely from liquified nitrogen exiting from reboiler 54.

Typical flow rates which are operable in the embodiment of FIG. 3 are given below:

| FLOWS FOR OXYGEN PRODUCT OF 9880 SCFH | |
|---|---|
| OXYGEN FEED | 15,320 |
| OXYGEN WASTE | 4,950 |
| PURE COLUMN VENT | 580 |
| NITROGEN CIRCULATION | 179,430 |

The following Table 1 gives examples of process conditions which are operable in the embodiment shown in FIG. 3.

TABLE 1

| STREAM | LINE NO. | VALUE |
|---|---|---|
| Feed oxygen | 222 | 29.47 psia |
| Waste oxygen | 224 | 8.42 psia |
| Oxygen vapor | 226 | 21.05 psia |
| Ultrapure Oxygen product | 236 | 22.0 psia |
| Nitrogen | 240 | 93.5 psia |
| Nitrogen | 248 | 70.5 psia |
| Nitrogen | 246 | 93.5 psia |
| Nitrogen | 254 | 68.0 psia |
| Nitrogen | 264 | 94.0 psia |
| Nitrogen | 284 | 63.5 psia |
| Nitrogen | 286 | 96.0 psia |
| Nitrogen | 262 | 94.6 psia |
| Column 32 | | 24.0 psia |
| Column 52 | | 26.0 psia |
| Composition of Waste oxygen | 230 | trace nitrogen |
| Composition of Waste oxygen | 230 | 10% Argon |
| Composition of Waste oxygen | 230 | 90% Oxygen |
| Composition of Ultrapure oxygen | 236 | <0.1 ppm trace hydrocarbons |
| Composition of Ultrapure oxygen | 236 | <10 ppm Argon |

Nitrogen is the preferred gas for supplying cooling to the process. It is preferred that the nitrogen gas employed be relatively pure to avoid deposits of trace impurities within the apparatus.

The invention process is preferably conducted substantially at or above ambient pressures. Preferred pressures within the stripping column and within the pure column are in the range of from about 10 psia to about 40 psia and most preferably from about 20 psia to about 30 psia. As shown in Table 1 above, excellent results have been obtained using the invention process to purify oxygen at pressures ranging from about 20 psia to about 30 psia.

At the above column pressures, the nitrogen for cooling is preferably pressurized by passage through the blower to about 98 psia.

The invention process has been described with respect to the purification of oxygen using nitrogen as the cooling medium in the process. It should be understood that it is intended that other low boiling gases can be purified by use of the invention process including among others nitrogen.

In the same manner, although nitrogen has been shown and is preferred as the cooling medium for use in the process, other liquified gases can be used including among others oxygen and liquified air, and mixtures of oxygen and/or nitrogen with liquified air. Some modification of the process temperatures will be required in these cases which will be well within the capability of one skilled in the art. For example if oxygen is to be purified and oxygen is also to be used as the cooling medium, very low pressures approaching a vacuum might need to be used in the stripping and pure columns.

Various other modifications of the invention are contemplated which will be obvious to those skilled in the art and can be resorted to without departing from the spirit and scope of the invention as defined in the claims.

I claim:

1. A process for the ultrapurification of cryogenic low boiling liquified gases containing trace impurities comprising:
   - introducing said cryogenic gas to be purified into a first distillation column, said cryogenic gas to be purified being substantially at its liquid-gas equilibrium temperature at the pressures within said first distillation column;
   - separating said cryogenic feed by distillation into a first cryogenic vapor fraction containing low boiling point impurities and a first cryogenic liquid fraction containing high boiling point impurities;
   - withdrawing said first cryogenic vapor fraction from said first distillation column;
   - introducing said first cryogenic vapor fraction into a second distillation column, said first cryogenic vapor fraction being substantially at its liquid-gas equilibrium temperature at the pressures within said second distillation column;
   - separating said first vapor fraction by distillation into a second vapor fraction containing low boiling point impurities and a second liquid fraction free of trace impurities; and,
   - withdrawing said second liquid fraction free of trace impurities as ultrapure product.

2. The process according to claim 1 wherein said cryogenic gas to be purified is oxygen.

3. The process according to claim 1 wherein said cryogenic gas to be purified is nitrogen.

4. A process for the ultrapurification of oxygen containing impurities by the cryogenic separation of oxygen from its impurities by distillation comprising:
   - introducing feed oxygen to be purified into a first distillation column, said oxygen being substantially at its liquid-gas equilibrium temperature at the operating pressures within said first distillation column;
   - separating said oxygen feed by distillation within said first distillation column into a hydrocarbon free oxygen vapor fraction and a hydrocarbon enriched oxygen liquid fraction;
   - withdrawing said hydrocarbon free oxygen vapor fraction from said first distillation column;
   - introducing said hydrocarbon free oxygen vapor fraction into a second distillation column, said hydrocarbon free oxygen vapor fraction being substantially at its liquid-gas equilibrium temperature at the operating pressures within said second distillation column;
   - separating said hydrocarbon free oxygen vapor fraction by distillation within said second distillation column into an impurity enriched oxygen vapor fraction and an ultrapure oxygen liquid fraction; and,
   - recovering said ultrapure oxygen liquid fraction as product.

5. A process as claimed in claim 4 wherein at least a portion of said hydrocarbon enriched oxygen liquid fraction is employed as liquid reflux for said first distillation column and at least a portion of said hydrocarbon free oxygen vapor is employed as vapor reflux for said first distillation column.

6. A process as claimed in claim 4 wherein at least a portion of said ultrapure oxygen liquid fraction is employed as liquid reflux for said second distillation column, and wherein at least a portion of said impurity enriched oxygen vapor fraction is employed as reflux vapor for said second distillation column.

7. A process as claimed in claim 4 wherein at least a portion of said hydrocarbon free oxygen vapor fraction is condensed by indirect heat exchange with a low boiling liquified gas, said low boiling liquified gas being substantially at its liquid-gas equilibrium temperature at the heat exchange operating pressures.

8. A process as claimed in claim 7 wherein at least a portion of said oxygen liquid fraction within said second distillation column is vaporized by indirect heat exchange with low boiling liquified gas, said low boiling liquified gas being substantially at its liquid-gas equilibrium temperature at the heat exchange operating pressures, and wherein at least a portion of said oxygen vapor fraction within said second distillation column is condensed by indirect heat exchange with low boiling liquified gas, said low boiling liquified gas being substantially at its liquid-gas equilibrium temperature at the heat exchange operating pressures.

9. A process as claimed in claim 8 wherein said low boiling liquified gas is selected from oxygen, nitrogen, air, and mixtures thereof.

10. The process of claim 9 wherein said low boiling liquified gas is oxygen.

11. The process of claim 9 wherein said low boiling liquified gas is liquified air.

12. A process as claimed in claim 8 wherein said low boiling liquified gas is nitrogen, and wherein said oxygen to be purified and said nitrogen are both obtained from an air separation process.

13. The combination of an air separation process and the process of claim 12.

14. The process of claim 12 wherein said impurity enriched oxygen vapor fraction is withdrawn from the upper half of said second distillation column and returned to the air separation process.

15. A process as claimed in claim 8 wherein said low boiling liquified gas is nitrogen, and wherein said oxygen to be purified and said nitrogen are both obtained from stored nitrogen and stored oxygen.

16. A process as claimed in claim 15 wherein said purification process is performed on site where the ultrapure oxygen product is to be used.

17. The process of claim 8 wherein said low boiling liquified gas is nitrogen which is recycled for reuse by:

repressurizing in a blower;

cooling in an aftercooler; and, further cooling by indirect heat exchange contact with process and heat exchange streams exiting from said first and second distillation columns.

18. The process of claim 17 wherein said nitrogen cooled by indirect heat exchange contact with process and heat exchange streams exiting from said first and second distillation columns is divided so that part of the nitrogen is brought into indirect heat exchange contact with at least a portion of said oxygen vapor fraction rising within said first distillation column and the remaining nitrogen is brought into indirect heat exchange contact with at least a portion of said oxygen vapor fraction rising within said second distillation column.

19. The process of claim 8 wherein said low boiling liquified gas is nitrogen and after being circulated into indirect heat exchange relation with at least a portion of said condensed oxygen liquid fraction in said second distillation column said nitrogen is then circulated into indirect heat exchange contact with at least a portion of said rising oxygen vapor fraction within said second distillation column.

20. A process as claimed in claim 4 wherein at least a portion of said feed oxygen is cooled by indirect heat exchange with at least a portion of said impurity rich oxygen liquid produced in said first distillation column.

21. A process as claimed in claim 7 wherein said low boiling liquified gas is selected from oxygen, nitrogen, air, and mixtures thereof.

22. The process of claim 21 wherein said low boiling liquified gas is oxygen.

23. The process of claim 21 wherein said low boiling liquified gas is liquified air.

24. A process as claimed in claim 4 wherein at least a portion of said oxygen to be purified is obtained from an air separation process.

25. The process of claim 4 wherein said first and second distillation columns operate at a pressure in the range of from about 10 psia to about 40 psia.

26. The process of claim 4 wherein said first and second distillation columns operate at a pressure in the range of from about 20 psia to about 30 psia.

27. The process of claim 4 wherein said oxygen feed stream is introduced into the lower half of said first distillation column.

28. The process of claim 27 wherein said hydrocarbon enriched oxygen liquid is withdrawn from a point within said first distillation column which is below said point of introduction of said oxygen feed stream.

29. The process of claim 4 wherein said hydrocarbon free oxygen vapor is withdrawn from the upper half of said first distillation column.

30. The process of claim 4 wherein said impurity enriched oxygen vapor fraction is withdrawn from the upper half of said second distillation column.

31. The process of claim 30 wherein said hydrocarbon free oxygen vapor fraction is introduced into said second distillation column at a point below the point of withdrawal of said impurity-rich vapor fraction.

32. The process of claim 4 wherein said impurity enriched oxygen vapor is withdrawn from the upper half of said second distillation column and then introduced into a crude Argon separation column for separation of Argon.

33. A process for the ultrapurification of oxygen containing impurities comprising:

introducing feed oxygen into a first distillation column operating at a pressure in the range of about 10 psia to about 40 psia, said feed oxygen being substantially at its liquid-gas equilibrium temperature at the operating pressures within said first distillation column;

separating said oxygen feed in said first distillation column by distillation into a hydrocarbon free oxygen vapor and a hydrocarbon impurity enriched oxygen liquid;

withdrawing at least a portion of said hydrocarbon impurity enriched oxygen liquid as waste from the lower half of said first distillation column;

withdrawing at least a portion of said hydrocarbon free oxygen vapor from the upper half of said first distillation column;

feeding said withdrawn hydrocarbon free oxygen vapor to a second distillation column operating at a pressure in the range of about 10 psia to about 40 psia, said feed hydrocarbon free oxygen vapor being substantially at its liquid-gas equilibrium temperature at the operating pressures within said second distillation column;

separating said hydrocarbon free oxygen vapor feed in said second distillation column by distillation into argon and nitrogen impurity enriched vapor and ultrapure oxygen liquid;

withdrawing said argon and nitrogen enriched vapor as waste from the upper half of said second distillation column; and, withdrawing said pure oxygen liquid as product from the lower half of said second distillation column.

34. The process according to claim 33 wherein:

at least a portion of said oxygen vapor feed is cooled by transferring heat by indirect heat exchange contact with at least a portion of said liquid oxygen waste stream withdrawn from said first distillation column.

35. The process according to claim 33 wherein:

at least a portion of said oxygen vapor within said first distillation column and said second distillation column is condensed to provide reflux for each said column by indirect heat exchange contact with a cryogenic liquid which is substantially at its liquid-gas equilibrium temperature at the heat exchange operating pressures which causes said cryogenic liquid to be vaporized.

36. The process according to claim 33 wherein:

at least a portion of said liquid oxygen at the bottom of said second distillation column is vaporized to form reboil for the column by indirect heat exchange contact with a vaporized cryogenic liquid which is substantially at its liquid-gas equilibrium temperature at the heat exchange operating pressures which causes said cryogenic liquid to be condensed.

37. The process according to claim 36 wherein:

said condensed cryogenic liquid which is substantially at its liquid-gas equilibrium temperature at the heat exchange operating pressures is used to condense oxygen vapor within said second distillation column by indirect heat exchange contact which produces vaporized cryogenic liquid.

38. Apparatus for the ultrapurification of cryogenic low boiling liquified gases comprising in combination:

a first distillation column equipped with a top column condenser;

a second distillation column equipped with a top column condenser and a bottom column reboiler;

at least one conduit means within said first distillation column for the introduction of liquids and vapors;

at least one conduit means within said said first distillation column for the withdrawal of liquids and vapors;

at least one conduit means within said second distillation column for the introduction of liquids and vapors;

at least one conduit means within said said second distillation column for the withdrawal of liquids and vapors;

at least one conduit means within said top column condenser of said first distillation column for the introduction of liquids and vapors;

at least one conduit means within said top column condenser of said first distillation column for the withdrawal of liquids and vapors;

at least one conduit means within said top column condenser of said second distillation column for the introduction of liquids and vapors;

at least one conduit means within said top column condenser of said second distillation column for the withdrawal of liquids and vapors;

at least one conduit means within said bottom reboiler of said second distillation column for the introduction of liquids and vapors;

at least one conduit means within said bottom reboiler of said second distillation column for the withdrawal of liquids and vapors;

a heat exchanger;

a blower;

an aftercooler;

at least one conduit means connecting at least one of said conduit means within said top column condenser of said first distillation column with said heat exchanger;

at least one conduit means connecting at least one of said conduit means within said top column condenser of said second distillation column with said heat exchanger;

at least one conduit means connecting at least one of said conduit means within within said bottom reboiler of said second distillation column with said heat exchanger;

at least one conduit means connecting said heat exchanger with said blower;

at least one conduit means connecting said blower with said aftercooler;

at least one conduit means connecting said aftercooler with said heat exchanger; and, at least one valve means within at least one of said conduit means.

39. An apparatus in combination according to claim 38 further comprising:

at least one conduit means joining at least one of said conduit means of said reboiler of said second distillation column with at least one of said conduit means of said top condenser of said second distillation column.

40. An apparatus in combination according to claim 38 further comprising:

at least one temperature indicator means within at least one of said conduit means, said heat exchanger, said columns, said condensers, and said reboiler;

at least one temperature indicator control means within at least one of said conduit means, said heat exchanger, said columns, said condensers, and said reboiler;

at least one pressure indicator means within at least one of said conduit means, said heat exchanger, said columns, said condensers, and said reboiler;

at least one pressure indicator control means within at least one of said conduit means, said heat exchanger, said columns, said condensers, and said reboiler;

at least one level indicator means within at least one of said conduit means, said heat exchanger, said columns, said condensers, and said reboiler;

at least one level indicator control means within at least one of said conduit means, said heat exchanger, said columns, said condensers, and said reboiler; and, at least one valve means responsive to said temperature indicator control means, said pressure indicator control means, and said level indicator control means.

41. An apparatus in combination according to claim 40 further comprising:

at least one filter means within said conduit means connected to said heat exchanger.

42. An apparatus in combination according to claim 41 further comprising:

a third distillation column;

at least one conduit means from said second distillation column to said third distillation column; and, at least one conduit means within said third distillation column for the introduction and withdrawal of liquids and vapors.

43. An apparatus in combination according to claim 38, further comprising:

a standard air separation unit;

at least one conduit means connecting said air separation unit with said first distillation column; and, at least one conduit means connecting said air separation unit with said second distillation column.

* * * * *